US012584291B2

(12) United States Patent
Krone et al.

(10) Patent No.: US 12,584,291 B2
(45) Date of Patent: Mar. 24, 2026

(54) CONTROL SYSTEM FOR RIPPER OPERATION

(71) Applicant: Caterpillar Inc., Peoria, IL (US)

(72) Inventors: Bradley P. Krone, Dunlap, IL (US); Christopher M. Gerth, Chillicothe, IL (US); Brad R. Van De Veer, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 112 days.

(21) Appl. No.: 18/392,915

(22) Filed: Dec. 21, 2023

(65) Prior Publication Data

US 2025/0207358 A1 Jun. 26, 2025

(51) Int. Cl.
*E02F 9/20* (2006.01)
*E02F 5/32* (2006.01)
*E02F 9/26* (2006.01)

(52) U.S. Cl.
CPC ..... *E02F 9/2041* (2013.01); *E02F 5/32* (2013.01); *E02F 9/262* (2013.01)

(58) Field of Classification Search
CPC ..... E02F 9/2041; E02F 9/262; E02F 5/32
See application file for complete search history.

(56) References Cited

U.S. PATENT DOCUMENTS 4,031,964 A 6/1977 Takahashi et al.
4,062,539 A 12/1977 Tetsuka et al.
5,293,944 A 3/1994 Matsumoto
5,685,377 A 11/1997 Artstein et al.
6,278,955 B1 8/2001 Hartman et al.
6,317,676 B1 11/2001 Gengler et al.
8,083,004 B2 12/2011 Knight, Jr.
8,616,297 B2 12/2013 Shintani et al.
8,788,157 B2 7/2014 Shintani et al.
9,033,062 B2 5/2015 Stratton et al.
9,292,813 B2 3/2016 Tucker et al.
9,435,102 B2 9/2016 Hall
9,624,650 B2 4/2017 Stratton
10,246,087 B2 4/2019 Mitchell et al.
10,518,637 B2 12/2019 Uemura et al.
11,215,781 B1 1/2022 Pino, Jr.
(Continued)

FOREIGN PATENT DOCUMENTS

CN 105002943 A 10/2015
CN 109797793 B 7/2021
(Continued)

OTHER PUBLICATIONS

U.S. Appl. No. 18/539,772, filed Dec. 14, 2023, Pending.
(Continued)

*Primary Examiner* — Russell Frejd

(57) ABSTRACT

A mobile machine is operatively attached to a ripper for conducting a ripping operation of the terrain substrate by traveling over the terrain surface. The mobile machine may be associated with sensors to measure the travel resistance from the terrain opposing travel of the mobile machine in the travel directing during the ripping operation. If the travel resistance is excessive, the mobile machine can conduct a shank adjustment sequence by adjusting one or more of a tilt actuator and a lift actuator to move the ripper relative to the terrain and reduce the travel resistance.

20 Claims, 4 Drawing Sheets

(56) References Cited

U.S. PATENT DOCUMENTS

| | | | | |
|---|---|---|---|---|
| 11,396,736 | B2 * | 7/2022 | Tevis | B62D 9/04 |
| 2012/0073843 | A1 | 3/2012 | Kure | |
| 2012/0318541 | A1 | 12/2012 | Sulzer | |
| 2012/0330523 | A1 * | 12/2012 | Jensen | B60W 10/30 701/70 |
| 2013/0173122 | A1 * | 7/2013 | Liu | E02F 9/2029 701/50 |
| 2017/0030052 | A1 | 2/2017 | Wei et al. | |
| 2017/0204588 | A1 | 7/2017 | Faivre et al. | |
| 2022/0316173 | A1 | 10/2022 | Narikawa et al. | |
| 2022/0327715 | A1 * | 10/2022 | Atkinson | G06V 20/40 |
| 2022/0372734 | A1 * | 11/2022 | Valeck | E02F 3/844 |

FOREIGN PATENT DOCUMENTS

| | | | |
|---|---|---|---|
| CN | 107313475 | B | 2/2023 |
| JP | 2013-217057 | A | 10/2013 |
| KR | 20150061822 | A | 6/2015 |
| KR | 102252607 | B1 | 5/2021 |
| WO | WO 2022/239296 | A1 | 11/2022 |

OTHER PUBLICATIONS

U.S. Appl. No. 18/394,268, filed Dec. 22, 2023, Pending.
U.S. Appl. No. 18/394,295, filed Dec. 22, 2023, Pending.
U.S. Appl. No. 18/545,653, filed Dec. 19, 2023, Pending.

* cited by examiner

CONTROL SYSTEM FOR RIPPER OPERATION

TECHNICAL FIELD

This patent disclosure relates generally to controlling operation of a mobile machine equipped with a ripper tool and, more particularly, to a control system for movably adjusting the ripper tool in response to terrain conditions.

BACKGROUND

Mobile excavation machines such as dozers, agricultural tractors, and motor graders may include one or more material engaging implements utilized to cultivate, dig, rip or otherwise disturb a ground surface. A ripping tool or ripper is an example of an implement that can be attached to a mobile machine and operated to penetrate into the terrain surface. As the mobile machine travels over the terrain surface, the ripper digs through and displaces the terrain substrate preparing it for subsequent operations.

The terrain surface and/or substrate can include non-homogenous loose soil or compacted material that can be easy or difficult for the machine to displace. As the machines traverse a site that has changing terrain and/or varying ground conditions, the magnitude of resistance applied to the implements by the material varies. The higher amounts of resistance can impede or stall travel of the mobile machine reducing operational efficiency.

U.S. Pat. No. 8,083,004 describes a control system for a machine having a power source, a traction device, and a ripping tool. The control system may have a slip sensor configured to generate at least one signal indicative of machine slippage, and at least one actuator operable to position the ripping tool. The control system may also have a controller in communication with the slip sensor, the at least one actuator, and the power source. The controller may be configured to receive at least one operator input indicative of an acceptable slip value, and determine actual machine slippage based on the at least one signal. The controller may also be configured to directly and separately regulate a speed of the machine and a position of the ripping tool during an excavation process based on the acceptable slip value and actual machine slippage.

The present disclosure solves one or more problems set forth above and/or other problems in the art.

SUMMARY

The disclosure describes, in one aspect, a mobile machine operatively attached to a ripper to conduct a ripping operation. The mobile machine includes a machine chassis supported on a plurality of traction/propulsion devices for traveling over a terrain surface in a travel direction. A ripper is attached to the machine chassis and includes a ripper shank and a ripper tip at a distal end of the ripper shank for penetrating the terrain surface. One or more sensors are operatively configured to measure a travel resistance to travel of the mobile machine over the terrain surface. The mobile machine includes a tilt actuator connected between the machine chassis and the ripper that is configured to tilt the shank axis with respect to the terrain surface. The mobile machine also includes a lift actuator connected between the machine chassis and the ripper that is configured to vertically move the ripper with respect to the terrain surface. An electronic controller communicates with the one or more sensors and is configured to actuate the tilt actuator and the lift actuator. The electronic controller is programmed to decide if the travel resistance as measured is excessive and to execute a shank adjustment sequence by actuating one or more of the tilt actuator and the lift actuator to move the ripper with respect to the machine chassis and reduce the travel resistance.

In another aspect, the disclosure describes a method of operating a ripper operably attached to a mobile machine. The method includes digging a terrain substrate with a ripper tip attached to a ripper shank of the ripper during travel of the mobile machine in a travel direction. The method measures the travel resistance opposing travel of the mobile machine over the terrain surface and decides if the travel resistance as measured is excessive. If travel resistance is excessive, the methodology executes a shank adjustment sequence by actuating one or more of a tilt actuator and a lift actuator to move the ripper with respect to terrain substrate and terrain surface to reduce the travel resistance.

In yet another aspect, the disclosure describes a control system for controlling a ripping operation. The ripping operation is conducted by a mobile machine that has an attached ripper as it travels over the terrain surface. The control system includes an actuator control operatively associated with a tilt actuator and a lift actuator that are configured to penetrate a ripper shank and ripper tip attached thereto into a terrain substrate during the ripping operation. The control system utilizes one or more sensors that are operatively configured to measure a travel resistance to travel of the mobile machine in a travel direction over the terrain surface. The control system includes an electronic controller programmed to decide if the travel resistance as measured is excessive and to execute a shank adjustment sequence by actuating one or more of the tilt actuator and the lift actuator to move the ripper shank and the ripper tip with respect to the terrain substrate to reduce the travel resistance.

DETAILED DESCRIPTION

Figure 1:
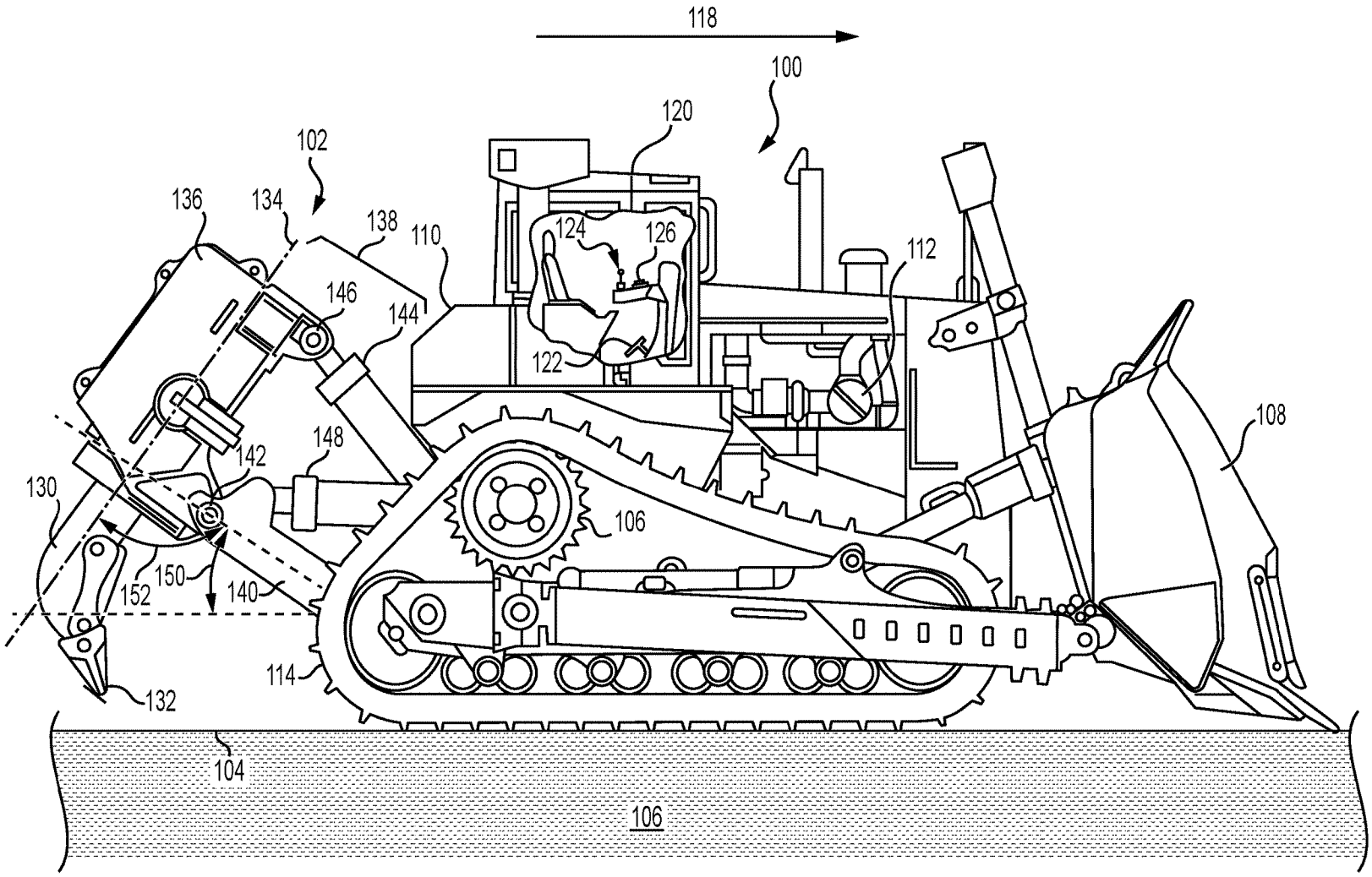
FIG. 1 is a schematic side view of an exemplary mobile machine equipped with a ripper for conducting a ripping operation on a terrain surface in accordance with an embodiment of the disclosure.

Now referring to the drawings, wherein whenever possible like reference numbers will refer to like elements, there is illustrated in FIG. 1 a mobile machine 100 equipped with a ripper 102 situated on a terrain surface 104. The terrain surface 104 can be located at a worksite associated with various industries such as mining, agriculture, construction, forestry, waste management, and material handling, among others. The mobile machine 100 may be an earth moving machine such as a motor grader, a dozer, a loader, a backhoe, an excavator, or any other type of earth moving machine. The machine 100 may traverse a work site to manipulate the terrain surface 104 and the terrain substrate 106 beneath the surface, e.g. transport, cultivate, dig, rip, and/or execute any other operation known in the art. In the illustrated embodiment, the mobile machine 100 is a track type dozer.

In the embodiment of a dozer, the mobile machine 100 can include a ground-engaging implement such as a blade 108 configure to push material over the terrain surface 104. The blade 108 can be hingedly attached to the forward end of a frame or machine chassis 110 so that the blade can be elevated above or lowered to contact the terrain surface 104. The mobile machine 100 can also be operably associated with any other suitable work implement for conducting various operations.

To propel the mobile machine 100 over the terrain surface 104, the mobile machine is equipped with a power source 112 configured to produce mechanical power. The power source 112 can be any type of internal combustion engine such as, for example, a diesel engine, a gasoline engine or a gaseous fuel powered engine. The power source 112 can combust the hydrocarbon-based fuel to convert the chemical energy therein to mechanical motive power and rotational torque. Further, the power source 112 can also be a non-engine power producing device such as, for example, a fuel cell, a battery, a motor, or another type of power source known in the art.

The mobile machine 100 can be supported on traction/propulsion devices 114 movable with respect to the machine chassis 110 and located on each side. In the illustrated embodiment, the traction/propulsion devices 114 can be continuous tracks that are operably driven by one or more sprockets 116. The sprockets 116 are operatively connected with the power source 112 through an intermediate group of components referred to as a drivetrain to receive motive power and drive the traction/propulsion devices 114. Translation of the traction/propulsion devices 114 with respect to the machine chassis 110 propels the mobile machine 100 over the terrain surface 102 along a travel direction 118. Further, relative translation of the traction/propulsion devices 114 can cause a steering change in the travel direction 118, thus steering the mobile machine 100. In addition to continuous tracks, the traction/propulsion devices 114 may also be wheels, belts, or other devices. Furthermore, the traction/propulsion devices 114 may be driven hydraulically, mechanically, electrically by motor, or actuated in any other suitable manner.

To accommodate an operator, the mobile machine 100 can include an operator station 120 located on top of the machine chassis 110 to provide visibility over the terrain surface 104. The operator station 120 can accommodate different controls for operation of the mobile machine 100. For example, to control the travel speed and velocity of the mobile machine 100 by adjusting the motive output of the power source 112, a deceleration pedal 122 can be located in the operator station 120 that operates by adjusting the quantity and/or timing of fuel injections or air introduced to the power source 112. Depressing the deceleration pedal 122 may reduce the travel speed of the mobile machine 100 in the travel direction 118 and releasing the deceleration pedal may increase the travel speed. To alter the travel direction 118, the operator station 120 can include a steering control 124 embodied as a joystick that can be manipulated by hand to steer the mobile machine 100. In additional to a joystick, the steering control 124 may be a conventional steering wheel. Also included in the operator station 120 can be a gear-shifter or a transmission selector 126 operatively associated with the drivetrain to set the operating gear of the mobile machine 100, which may include drive or forward, neutral, reverse or park settings. The operator station 120 can also include controls for operating the ripper 102 as described below.

In accordance with the disclosure, the mobile machine 100 can be operated manually, autonomously, or semi-autonomously. During manual operation, an operator controls and directs essentially all the functions and activities of the machine using the controls in the operator station 120 described above. Manual operation may also occur remotely wherein the operator is located off board the mobile machine 100 and operation is controlled through a remote control and wireless communication techniques.

In autonomous operation, the mobile machine 100 can operate responsively to information about the operating and environmental conditions provided from various sensors by selecting and executing various predetermined responses to the received information. In semi-autonomous operation, an operator either onboard or working remotely may perform some tasks and functions while others are conduced automatically in response to information received from sensors.

In any of the foregoing embodiments, to conduct a ripping operation with the mobile machine 100, the ripping tool or ripper 102 attached to rear of the machine chassis 110 is structurally configured with a curvature and tapper to penetrate into terrain surface 104 and displace a portion of the terrain substrate 106. The ripper 102 includes a ripper shank 130, which may be straight or slightly curved length of structural steel, and ripper tip 132 attached at the distal end of the shank. The ripper shank 130 defines a shank axis 134 and the ripper tip 132 can be disposed at an angle to the shank axis 134 to provide a curvature to the shape of the ripper 102 that facilities pentation and displacement of the terrain surface 104 and terrain substrate 106. The ripper tip 132 can be detached from the ripper shank 130 to allow different ripper tip configurations to be interchangeably used with the ripper 102 for different terrain materials and ripping operations.

To hold and attach the ripper shank 130 to the machine chassis 110, the ripper 102 includes a mounting member 136 connected with the machine chassis 110 via a mounting frame 138. The mounting member 136 can have a block-like steel structure with a central bore into which the straight portion of the ripper shank 130 can be inserted and secured. The shank axis 134 is therefore spatially fixed with respect to the block-like structure of the mounting member 136. Insertion of the ripper shank 130 into the mounting member 136 can be adjustable so that the distance the ripper shank extends therefrom can be changed to accommodate different configurations and/or sizes of the machine chassis 110 to which it is connected.

The mounting frame 138 may be configured to move the mounting member 136 and the ripper shank 130 retained therein to positions that are vertically higher, vertically lower, away from or forward towards the machine chassis 110. To move the mounting member 136 and ripper shank 130, the mounting frame 138 is configured as a linkage assembled of rigid links and pivoting joints that articulate with respect to each other. In an embodiment, the mounting frame 138 may be a multiple bar parallelogram that allows constrained motion of the shank axis 134 vertically and parallel with respect to, for example, the terrain surface 104.

The mounting frame 138 can include a rigid mounting link 140 that is pivotally connected to the mounting member 136 and that is connectively linked to the machine chassis 110 thereby spacing the structures apart from each other. In particular, the mounting link 140 connects to the bottom of the mounting member 136 at a first revolute joint or pivot joint 142 that enables relative rotation between the structures. Pivoting the mounting member 136 at the first pivot joint 142 changes or tilts the angular orientation of the shank axis 134 with respect to the machine chassis 110 and the terrain surface 104.

To tilt the shank axis 134, the mounting frame 138 can include a hydraulic tilt actuator 144 that extends between the machine chassis 110 and that is pivotally connected to the top of the mounting member 136 at a second revolute joint or pivot joint 146. Extension and retraction of the tilt actuator 144 pivots the mounting member 136 about the first pivot joint 142 where it connects to the mounting link 140. Pivoting the mounting member 136 also changes the angular orientation of the shank axis 134 that is constrained within the mounting member 136. To vertically raise and lower the mounting member 136 with respect to the machine chassis 110, a hydraulic lift actuator 148 is located between the structures and, in an embodiment, may be pivotally connected to machine chassis 110 and the mounting link 140. Actuation of the lift actuator 148 pivots the rigid mounting link 140 with respect to the machine chassis 110, which results in vertically raising or lowing the mounting member 136 to which the mounting link 140 is connected.

Per conventional design, the tilt and lift actuators 144, 148 can include a hollow cylinder body inside of which is located a reciprocally movable a piston attached to an elongated rod. The rod projects from and can extend and retract with respect to one end of the cylinder body when pressurized hydraulic fluid is introduced to or removed from the cylinder body. The mobile machine 100 can be equipped with a hydraulic system to supply pressurized hydraulic fluid to the tilt and lift actuators 144, 148.

The movable configuration of the mounting frame 138 produces distinct referential angles that change in degree or angular magnitudes in relation to movement of the ripper 102. For example, a mounting frame angle 150 may be defined where the machine chassis 110 is pivotally connected with the mounting link 140. The machine chassis 110 can be considered adjacent and parallel to the terrain surface 104 on which it is situated, and therefore may be parallel with the travel direction 118. The mounting frame angle 150, as defined by the horizontal machine chassis 110 and the mounting link 140 that extends from the machine chassis 110, can change by actuation of the lift actuator 148 thus vertically raising or lowering the ripper 102 with respect to the terrain surface 104.

The mounting frame 136 can also be associated with a shank axis angle 152 that may be defined by the orientation of the shank axis 134 with respect to the extension of the mounting link 140. Because extension and retraction of the tilt actuator 144 tilts the mounting member 136 and shank axis 134 about the first pivot joint 142, the tilt actuator 144 also can change the angular magnitude of the shank axis angle 152. Changing the shank axis angle 152 relatedly changes the angular orientation of the ripper shank 130 and the shank axis 134 with respect to the terrain surface 104.

Movement of the ripper 102 may correspond to a plurality of predetermined locations and/or orientations (i.e. angle settings of the ripper shank 130 and the associated shank axis 134). For example, the ripper shank 130 may have a discrete penetration angle and a discrete dig angle that may change based on material composition of the terrain surface 104, a size or capacity of the mobile machine 100, the configuration of the ripper shank 130 relative to the mounting member 136, and/or the configuration of the ripper tip 132. The operator can control the tilt and lift actuators 144, 148 to adjust the mounting frame angle 150 and/or the shank axis angle 152 during the ripper operation to move the ripper 102 into positions for conducting penetration or digging of the terrain surface 104.

In one example, illustrated in FIG. 1, the penetration angle of the ripper shank 130 may be tilted back from a vertical alignment normal to the terrain surface 104 to facilitate efficient penetration. In the illustrated penetration position, the tilt actuator 144 can be adjusted so that the ripper tip 132 is directed toward the terrain surface 104 and is located aft of the machine chassis 110 rearward from the travel direction 118. This may correspond to an increase in the shank axis angle 152. Also prior to penetration, the lift actuator 148 may be retracted to vertically raise the ripper 102 over the terrain surface 104, which corresponds to an increase in the mounting frame angle 150.

Figure 2:
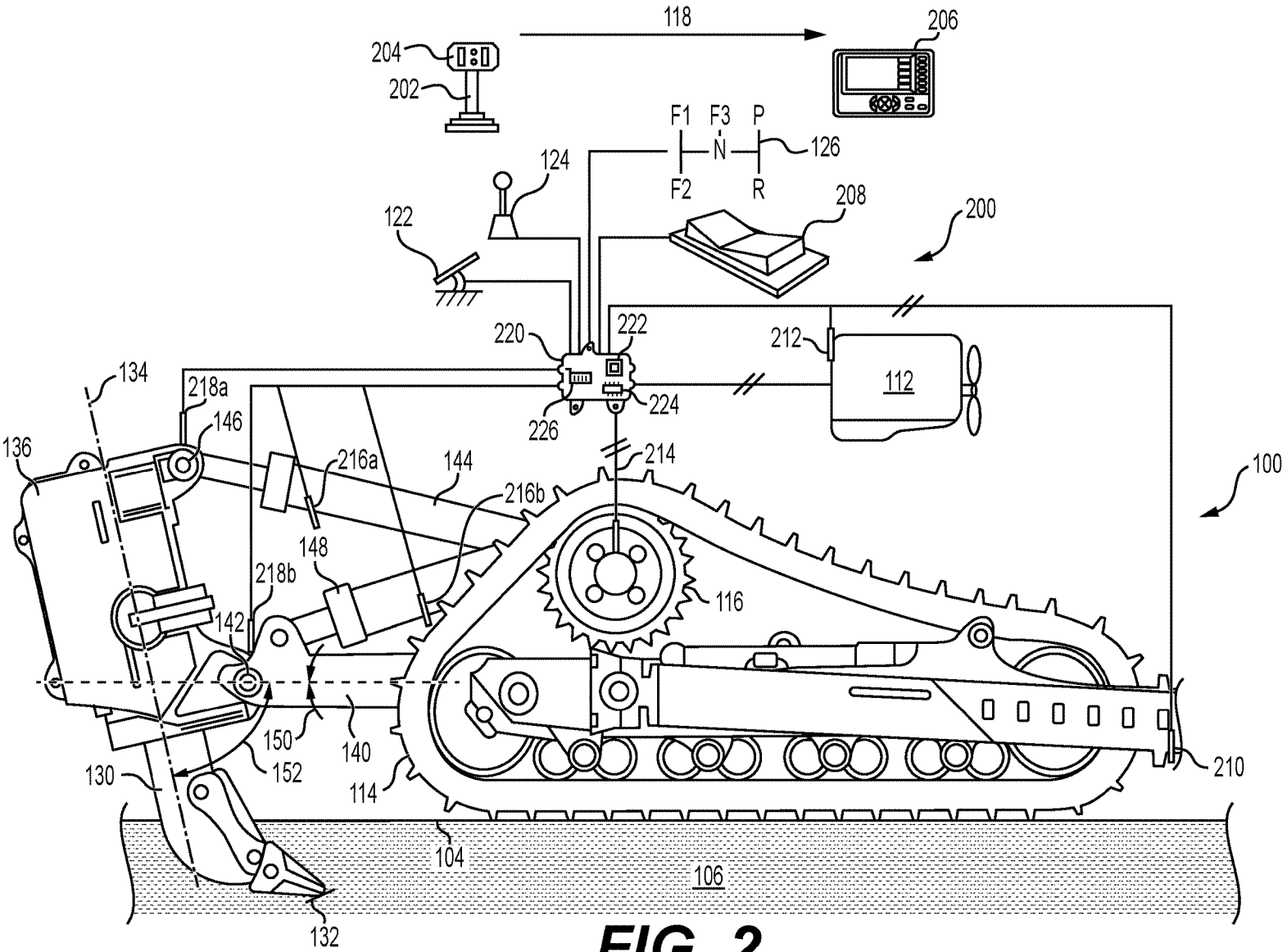
FIG. 2 is a schematic representation of the ripper moved to a digging position with respect to the machine chassis during a ripping operation in accordance with some embodiments.

Referring to FIG. 2, the operator may then controller the lift actuator 148 to vertically lower the ripper 102 so the ripper tip 132 penetrates into the terrain surface 104 to a desired digging depth into the terrain substrate 106. Vertically lowering the ripper 102 corresponds to decreasing the mounting frame angle 150 that, as illustrated in FIG. 2, may be reduced to zero degrees.

Once the ripper tip 132 has penetrated to the desired digging depth in the terrain substrate 106, the operator can control the tilt actuator 144 to pivot the mounting member 136 and ripper shank 130 therein to a desired digging angle as illustrated. This also pivots the shank axis 134 forward with respect to the machine chassis 110 and the terrain surface 104 decreasing the shank axis angle 152. Decreasing the shank axis angle 152 so that it corresponds to the desired digging angle and moves the ripper tip 132 forward toward the machine chassis 110. The ripper tip 132 is therefore aligned with the travel direction 118, and is positioned to penetrate into and fractures the terrain substrate 106 as the mobile machine 100 travels forward in the travel direction 118 while digging.

During the digging operation, the terrain surface 104 and substrate 106 will resist movement of the ripper shank 130 and the ripper tip 132 forward in the travel direction 118. In some cases, the terrain conditions may be such that it is excessively difficult to fracture and displace the terrain substrate 106, for example, if the substrate comprises hard rock or mineral ores. The difficulty in moving the ripper tip 132 through the terrain substrate 106 can result in and be characterized by resistance to movement of the mobile machine 100 in the travel direction 118, referred to as travel resistance. Excessive travel resistance may decrease the efficiency of the ripping operation, for example, by requiring the power source 112 to combust an excessive amount of fuel or slowing travel speed of the mobile machine 100 and thus the ripping operation. Excessive travel resistance can also result in damage to the ripper 102 as it is forced to dig through the terrain substrate 106.

In some instances, the hardness of the terrain substrate 106 may be localized and may vary as the mobile machine 100 and the ripper 102 attached thereto travel over the terrain surface 104 in the travel direction 118. The changes in localized hardness corresponds with persistent variations in the travel resistance imparted to the mobile machine 100 during the ripping operation. To address changing terrain conditions and the associated changes in travel resistance, the mobile machine 100 can include a control system operatively associated with and configured to movably adjust the ripper 102.

Referring to FIG. 2, there is illustrated the control system 200 having components configured to movably adjust the ripper 102 during a ripping operation. For example, during manual operation of the mobile machine 100, the control system 200 can be operatively associated with controls and input/output devices to interface with an operator of the mobile machine 100. As described above with respect to the operator station 120, the control system 200 can be associated with the deceleration pedal 122 to control the travel speed and with the steering control 124 to change the travel direction 118 of the mobile machine 100.

To enable the operator to control operation of the ripper 102, the control system 200 can also include a ripper control 202 that also may be located in the operator station 120. The ripper control 202 may allow the operator to adjust the vertical height of the ripper 102 above or below the terrain surface 104 and/or adjust the angle of the shank axis 134 with respect to the terrain surface 104 and the machine chassis 110 supported thereon. The ripper control 202 can operate by controlling the quantity or pressure of the hydraulic fluid supplied to or drained from the tilt actuator 144 and the lift actuator 148. The ripper control 202 may be embodied as a joystick or may be in the form of another suitable control apparatus known in the art. The ripper control 202 may also include one or more pushbuttons 204 that can be used to input, activate, or deactivate prearranged operational settings associated with the ripping operation. By way of example, the prearranged settings may correspond to a desired digging depth of the ripper tip 132 in the terrain substrate 106 and/or a desired digging angle of the shank axis 134 with respect to the terrain surface 104, which may be set in reference to the shank axis angle 152.

To interface with the operator, the control system 200 can include a human machine interface (HMI) that may be embodied as a visual display screen 206. The visual display screen 206 can visually present information to a human operator regarding operation of the mobile machine 100. The visual display screen 206 can be an organic light emitting diode screen ("OLED"), or any other suitable flat screen display capable of presenting numerical values, text descriptors, graphics, graphs, charts and the like regarding operation. The visual display screen 206 may have touch screen capabilities to receive input from a human operator, although in other embodiments, other interface devices may be included such as dials, knobs, switches, keypads, keyboards, mice, printers, etc.

In addition, in embodiments wherein the mobile machine 100 is configured for autonomous or semi-autonomous operation, or aspect of the ripping operation for example are automated, the control system 200 can be associated with an automatic setting switch 208 that can be embodied as a toggle switch. The operator can position the automatic setting switch 208 to activate automated operation of certain aspect of the mobile machine and can change the position the automatic setting switch to terminate automated operation of those activities. In addition, the operator may use other controls and/or input/output devices to override automated operation. For example, by manually manipulating the ripper control 202, the operator may assume active control over operation of the ripper 102 and terminate any automated settings or sequences.

To receive information about the current operating conditions and activities of the mobile machine 100, the control system 200 can be operatively associated with a plurality of sensors. The sensors may be any device for detecting or measuring a physical condition or change therein and outputting data representative of that occurrence. The sensors can work on any suitable operating principle for the assigned task, and may make mechanical, electrical, visual, and/or chemical measurements.

For example, to measure the travel speed or velocity of the mobile machine 100 with respect to the terrain surface 104, a ground speed sensor 210 can be located at a suitable location on the machine chassis 110. In an embodiment, the ground speed sensor 210 can be a reflective sensor that projects acoustic waves or radiofrequency waves toward the terrain surface 104 and detects the reflection back. The ground speed sensor 210 can therefore measure the true or actual speed or velocity of the mobile machine 100 over the terrain surface 104.

In another example, the ground speed sensor 210 can be operatively associated with a global navigation satellite system (GNSS) or global positioning satellite (GPS) system. In the GNSS or GPS system, a plurality of manmade satellites orbit about the earth at fixed or precise trajectories. Each satellite includes a positioning transmitter that transmits positioning signals encoding time and positioning information towards earth that can be received by the ground speed sensor 210. By calculating, such as by triangulation, between the positioning signals received by the ground speed sensor 210 from different satellites, the control system 200 can determine their instantaneous location on earth and the relative travel speed of the mobile machine 100 with respect to the terrain surface 104.

To measure the performance or output of the power source 112, the control system 200 can be associated with one or more engine sensors 212. The engine sensors 212 can measure parameters or characteristics associated with the power source 112 such as motive output quantified as variable such as torque or revolutions per minute (RPM). The engine sensors 212 may also measure parameters reflecting combustion or efficiency, such as fuel or airflow rate into the engine, engine temperature, etc.

To measure utilization of the motive output from the power source 112, the control system 200 can be associated with a drivetrain sensor 214. For example, a drivetrain sensor 214 can be operatively associated with the traction/propulsion devices 114 and/or the drive sprocket 116. The drivetrain sensor 214 can be a rotary encoder that measures the revolutions made by the drive sprocket 116 to determine the driven travel speed of traction/propulsion devices 114. The translating speed of the traction/propulsion devices 114 reflects the commanded speed or velocity of the mobile machine 100, which as described in the Background may vary with respect to the true or actual speed of the mobile machine due to machine slippage.

To determine the present position and current movements of the ripper 102, the control system 200 can be associated with one or more ripper position sensors. In an embodiment, to determine the spatial position of the ripper 102, the ripper position sensors may be operatively associated with the hydraulic lift and tilt actuators 144, 148 and can be referred to a tilt actuator sensor 216*a* and a lift actuator sensor 216*b* respectively. The tilt and lift actuator sensors 216*a*, 216*b* can be fluid pressure sensors or flowrate sensors that measure the hydraulic pressure in the tilt and lift actuators 144, 148 and/or the flow quantity of hydraulic fluid introduced to or drained from the lift and tilt actuators 144, 148.

In another embodiment, the tilt and lift actuator sensors 216*a*, 216*b* can be travel sensors that measure the extension and retraction of the piston rods of the tilt and lift actuators 144, 148. The ripper positon sensors may also be rotary encoders including a tilt encoder 218*a* associated with the first pivot joint 142 and a lift encoder 218*b* associated with the second pivot joint 146.

Using dimensional data about the mounting frame 138 and the machine chassis 110, the control system 200 can apply kinematic equations to the information output from tilt and lift actuator sensors 216*a*, 216*b* and/or the tilt and lift encoders 218*a*, 218*b* to calculate the position of the ripper 102 with respect to a reference such as the terrain surface 104. For example, the control system 200 can calculate the current digging depth of the ripper tip 132 in the terrain substrate 106 or the digging angle of the shank axis 134 with respect to the terrain surface 104. The control system 200 may process the digging depth and digging angle of the ripper 102 in angular terms corresponding to the ripper frame angle 150 and the shank axis angle 152.

In other possible embodiments, the ripper position sensors can include or use visual sensors or machine vision technology such as smart cameras. The smart camera can be configured to determine the current position and motion of the ripper 102 by processing a visual image captured of the mounting member 136 and/or mounting frame 138 with respect to a background such as the terrain surface 104. The use of machine vision technology and image processing can supplement or replace the use of kinematic equations to determine the position and motion of the ripper 102.

In other embodiments, the ripper position sensors can an inertial measurement units (IMU) operatively associated with the ripper 102. The IMU can measure the applied forces caused by motion and/or acceleration of the device and can therefore determine its orientation and/or position. In an embodiment, the IMU can be sensitive to magnetic fields to obtain orientation with respect the magnetic field of the Earth. The information obtained by the IMU provides contextual reference and spatial associations about the physical arrangement and position of the ripper 102.

To process the data received from the plurality of sensors and thereby assist in operation of the mobile machine 100 and particularly the ripper 102, the control system 200 can include an electronic controller 220. The electronic controller 220 can be a computerized and programmable device including hardware components and software programming capable of conducting logical operations on input data to produce a resulting output used in the operation of the mobile machine 100. Although illustrated as a single component, in different embodiments, the functionality of the electronic controller 220 can be distributed among a plurality of separate components.

The electronic controller 220 can include one or more microprocessors 222 for executing software instructions and processing computer readable data. Examples of suitable microprocessors include programmable logic devices such as field programmable gate arrays ("FPGA"), dedicated or customized logic devices such as application specific integrated circuits ("ASIC"), gate arrays, a complex programmable logic device, or any other suitable type of circuitry or microchip. To store application software and data, the electronic controller 220 can include a non-transitory computer readable and/or writeable data memory 224, for example, read only memory ("ROM"), random access memory ("RAM"), EEPROM memory, flash memory, or etc.

To interface and network with the other components of the control system 200 and other operational systems on the mobile machine 100, the electronic controller 220 can include an input/output interface 226 to electronically send and receive non-transitory data and information. The input/output interface 226 can be physically embodied as data ports, serial ports, parallel ports, USB ports, jacks, and the like to communicate via conductive wires, cables, optical fibers, or other communicative bus systems. Communication between the electronic controller 220 and the rest of the control system 200 can occur via any suitable communication protocol for data communication including sending and receiving digital or analog signals synchronously, asynchronously, or elsewise. For example, the input/output interface 226 can be communicatively connected and exchange data and information embodied as electronic signals or pulses with the plurality of sensors.

The electronic controller 220 can control aspects of a ripping operation including movement and spatial positioning of the ripper 102. In an embodiment, the electronic controller 220 can receive and process electronic data signals from the ripper position sensors to determine the current state of the ripper 102 in terms of position and motion. For example, the electronic controller 220 can determine the relative vertical height of the ripper 102 with respect to a reference, such as the terrain surface 104 or machine chassis 110. The electronic controller 220 can also determine the angular position of the ripper 102, for example, the angular orientation of the shank axis 134, with respect to a reference such as the terrain surface 104 or machine chassis 110. To fix the determination with respect to a coordinate system, the vertical elevation or location and angular position of the ripper 102 can be described with respect to the mounting frame angle 150 and the shank axis angle 152, although any suitable coordinate or reference system can describe the position of the ripper 102.

To move the ripper 102 in accordance with a planned operation or activity such as penetrating or digging, the electronic controller 220 can send data output signals to actuate the tilt and lift actuators 144, 148. For example, when the tilt and lift actuators 144, 148 are hydraulic operated, the electronic controller 220 can open and close the appropriate flow control or directional control valves to direct hydraulic fluid to or from the actuators. The electronic controller 220 can cause actuation by manipulating the electrical power provided to electromagnetic solenoids operatively associated with the fluid valves.

In particular, by actuating the lift actuator 148, the electronic controller 220 adjusts the mounting frame angle 150 that results in vertically raising or lowering the ripper 102. The electronic controller 220 can use the lift actuator 148 during a penetration sequence to penetrate the ripper tip 132 into the terrain surface 104 or during a digging sequence to vertically position the ripper tip 132 at the desired digging depth in the terrain substrate 106. The electronic controller 220 can use the tilt actuator 144 to adjust the angular orientation of the shank axis 134, which can correspond to changes to the shank axis angle 152. For example, the shank axis 134 can be tilted reward of the machine chassis 110 in the travel direction 118 to orientate and direct the ripper tip 132 toward the terrain surface during penetration. The shank axis 134 can be tilted forward toward the machine chassis 110 to orientate and align the ripper tip 132 with the travel direction 118 and into the terrain substrate 106 to fracture and displace material during a digging sequence.

INDUSTRIAL APPLICABILITY

Figure 3:
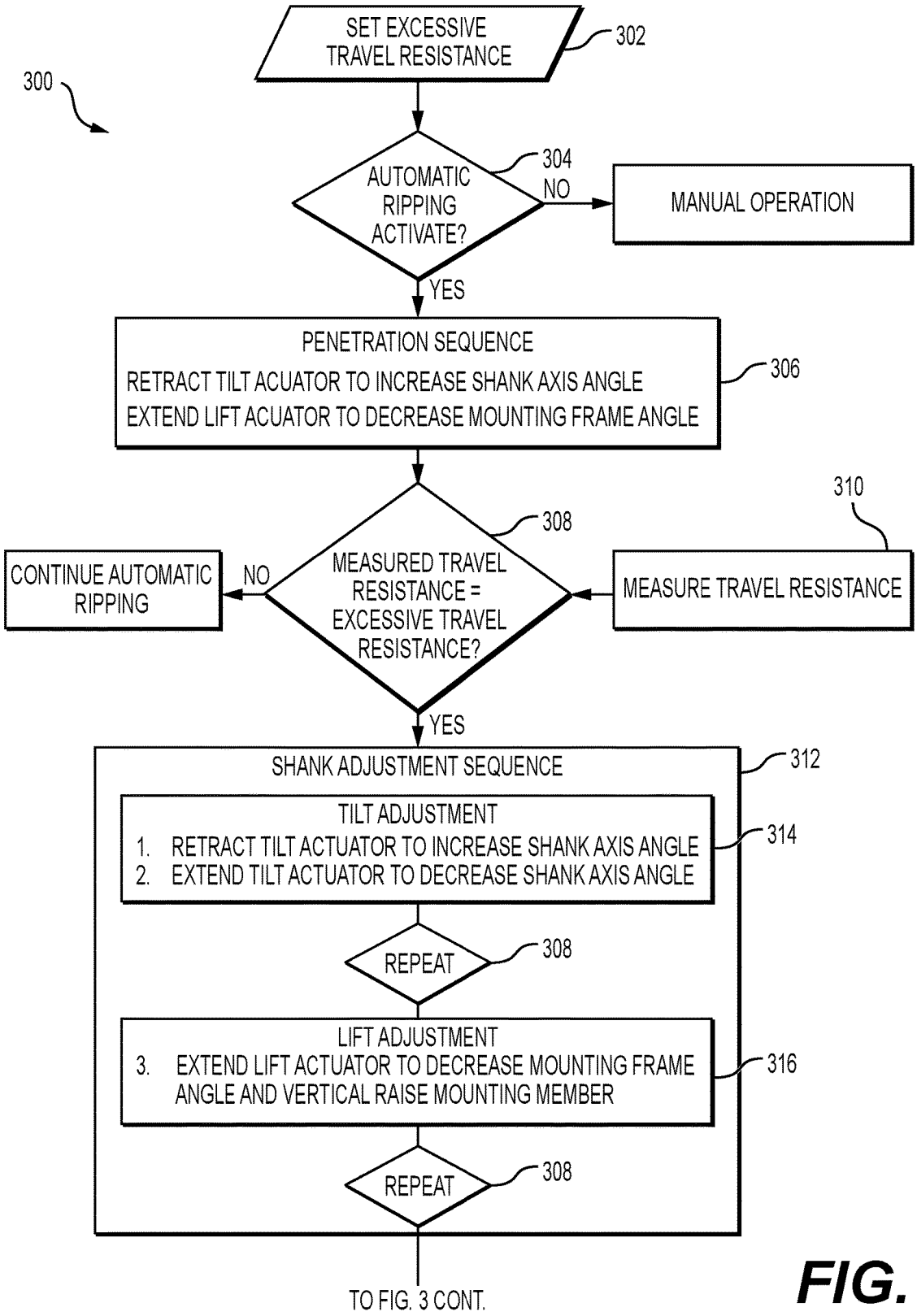
FIG. 3 is a flow diagram of a method executed by the control system for automatically conducting a shank adjustment sequence moving the ripper in accordance with some embodiments.
Figure 3:
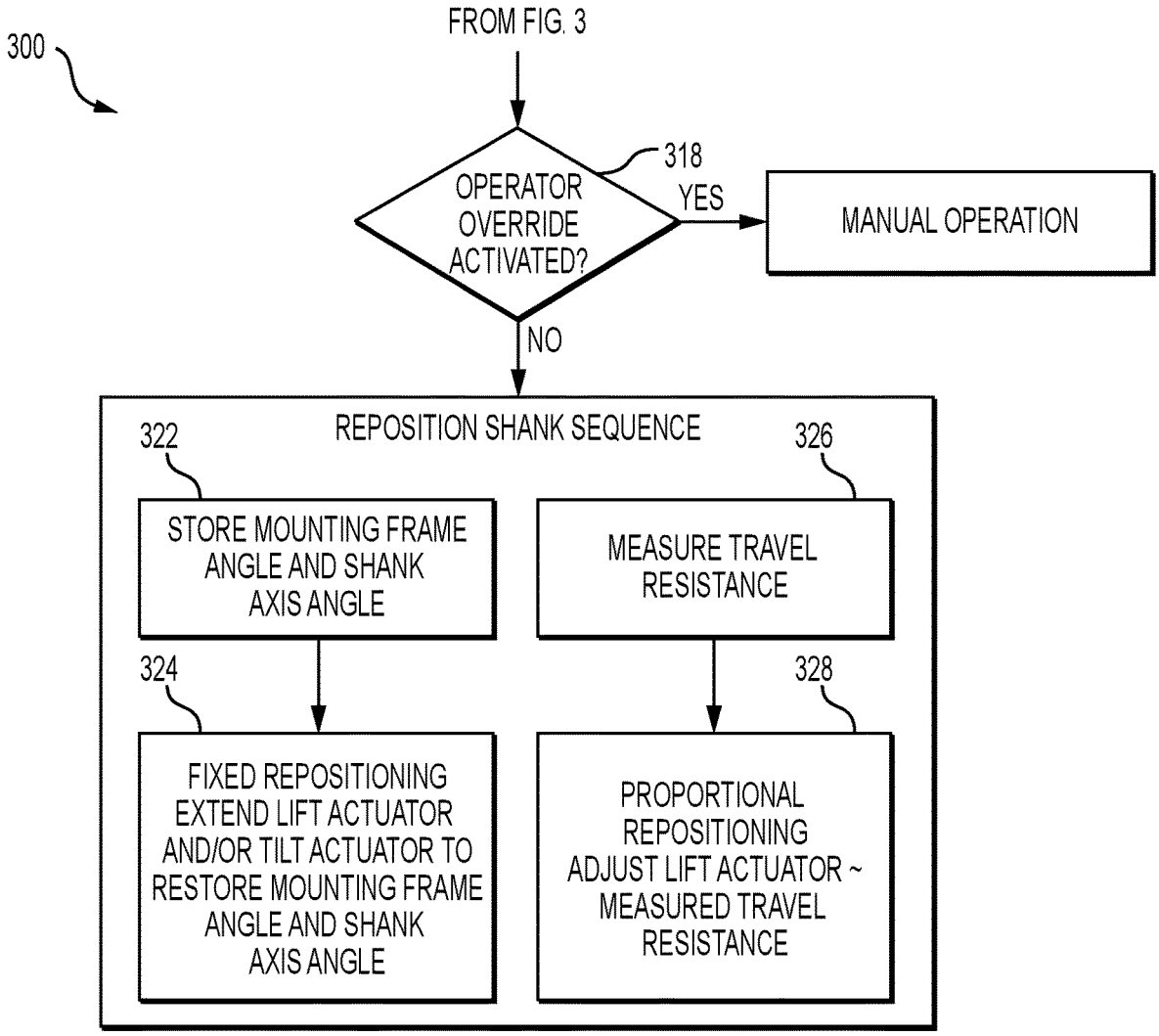

Referring to FIG. 3, with continued reference to the previous figures, there is illustrated an embodiment of a process or an automated method 300 by which the control system 200 can operatively automate a portion of a ripping operation. The automated method 300 or process illustrated in FIG. 3 can be embodied as a computer readable program written as software in a suitable computer programming language and can be executed by the electronic controller 220 associated with the control system 200. In an embodiment, the automated method 300 can be configured to address difficulties arising from localized variations in the terrain conditions, and particularly in variations in material hardness or travel resistance encountered during a ripping operation. The automated method 300 can occur during fully autonomous operation of the mobile machine 100 or to assist an operator during manual operation.

In a value setting step 302, a numerical value corresponding to excessive travel resistance may be entered to the control system 200. Excessive travel resistance can be defined, for example, as the opposition to mobile travel of mobile machine 100 in the travel direction 118 that diminishes operational efficiency of the ripping operation. Excessive travel resistance can be measured in a number of ways including an increased load or demand on the power source 112 as measured by the engine sensor 212 or by machine slip defined as the difference between the actual travel speed measured by the ground speed sensor 210 and the driven travel speed measured by drivetrain sensor 214. Excessive travel resistance can assume any suitable dimension or value and can be manually entered by an onboard operator using pushbuttons 204 on the ripper control 202 or the HMI 206. Excessive travel resistance can also be a rating or a parameter associated with the design and configuration of the mobile machine 100 or the ripper 102.

To assign operational control of the mobile machine 100 and/or ripper 102 to the control system 200, the automated method 300 can include an activation step 304. The operator may use the automatic setting switch 208 to activate automatic operation and pass operational control of the ripper 102 over to the control system 200. If the activation step 304 has not been activated, the control system 200 disengages and dismisses operational control over the ripper 102, which is assumed manually by the operator.

The automated method 300 may include a piercing or penetration sequence 306 in which the control system 200 maneuvers the ripper 102 to penetrate into the terrain surface 104. For example, the electronic controller 220 can communicate electronic control signals to the tilt and lift actuators 144, 148 to conduct a sequence of operations moving the ripper 102 accordingly.

To direct the ripper tip 132 toward the terrain surface 104 when the mounting member 136 has been lifted, the penetration sequence 306 can retract the tilt actuator 144 to tilt the shank axis 134 aft or reward from the machine chassis 110. Retracting the tilt actuator 144 increases the shank axis angle 152. In accordance with the penetration sequence 306, the control system 200 can then extend the lift actuator 148 decreasing the mounting frame angle 150 and moving the mounting member 136 vertically downward to cause the ripper tip 132 to penetrate the terrain surface 104. Extension of the lift actuator 148, and correspondingly reduction of the mounting frame angle 150, can continue until the ripper tip 132 is vertically lowered to a desired digging depth in the terrain substrate 106.

During the digging mode of the ripping operation, the mobile machine 100 travels in the travel direction 118 moving the ripper shank 130 and ripper tip 132 through the terrain surface 104 and terrain substrate 106. To determine if the terrain conditions have become excessively resistive to machine travel, the control system 200 can conduct a travel resistance decision 308 in which the value setting indicative of excessive travel resistance set in the value setting step 302 is compared with a measured travel resistance.

The control system 200 can obtain the measured travel resistance in a measurement step 310 conducted by any suitable methodology including by measuring the instantaneous load on the power source 112 or the measured machine slippage. If the travel resistance decision 308 determines that the measured travel resistance equals or exceeds the value for the excessive travel resistance set in the value setting step 302, the control system 200 proceeds to a shank adjustment sequence 312. In accordance with the automated method 300, the travel resistance decision 308 and the travel resistance measurement step 310 can occur automatically and continuously.

The shank adjustment sequence 312 can include a sequence of actions to facilitate digging progression of the ripper tip 132 through the terrain substrate 106. For example, the shank adjustment sequence 312 can include a tilt adjustment 314 wherein the electronic controller 220 actuates the tilt actuator 144 to adjust the shank axis angle 152. The tilt adjustment 314 can include retracting the tilt actuator 144 to increase the shank axis angle 152 and extending the tilt actuator 144 to decrease the shank axis angle 152. The tilt adjustment 314 moves the ripper tip 132 aft and reward from the machine chassis 110 then forward in the travel direction 118 toward the machine chassis 110. The ripper tip 132 is therefore moved to repeatedly strike the material of the terrain substrate 106 to fracture and break it up.

To determine if the tilt adjustment 314 successfully reduced the travel resistance, the shank adjustment sequence 312 can repeat the travel resistance decision 308 comparing the instantaneously measured travel resistance with the excessive travel resistance setting. If the repeated travel resistance decision 308 determines the travel resistance remains excessive, the shank adjustment sequence 312 can include other actions to reduce the travel resistance.

For example, the shank adjustment sequence 312 can include a lift adjustment 316 wherein the electronic controller 220 actuates the lift actuator 148 to vertically lift the mounting member 136. In an embodiment, extending the lift actuator 148 increases the mounting frame angle 150 thereby moving the mounting member 136 and ripper tip 132 vertically upwards with respect to the terrain surface 104 and the machine chassis 110. That removes a portion of the ripper shank 130 from the terrain substrate 106 such that the ripper 102 will encounter less travel resistance when moving in the travel direction 118 during the ripping operation. The shank adjustment sequence 312 can again repeat the travel resistance decision 308 to determine if travel resistance remains excessive and, if so, can repeat the tilt adjustment 314 or lift adjustment 316.

The automated method 300 executed by control system 200 can include other steps and sequences of action to facilitate a ripping operation. For example, to enable the operator to reassume control over the ripping operation, the automated method 300 can incorporate an override decision 318. In particular, the operator can actuate one of the interfaces, such as manually manipulating the ripper control 202 or actuating pushbuttons 204 thereon, to disengage and exit the automated method 300 performed by the control system 200. For example, the operator may intend to address the excessive travel resistance differently than as provided by the shank adjustment sequence 312.

If the shank adjustment sequence 312 is successful in reducing the excessive travel resistance such that the ripping operation proceeds, the automated method 300 can include a reposition shank sequence 320 to return the ripper 302 to the desired digging depth and digging angle. In an embodiment, reposition shank sequence 320 can return the ripper 102 to a fixed position. For example, the automated method 300 can include a storage step 322 in which the desired digging depth and the desired digging angle may be stored as data in memory 224 associated with the electronic controller 220. The digging depth and digging angle may be stored in referential terms to the mounting frame angle 150 and the shank axis angle 152, however, any suitable coordinate and reference system can be used. The digging depth and the digging angle can also be associated with the actuation settings, in terms of extensions and retraction, of the tilt and lift actuators 144, 148 prior to the shank adjustment sequence 312. The storage step 322 can be conducted at any suitable time and may precede the shank adjustment sequence 312.

In a fixed repositioning step 324, the control system 200 can retrieve the mounting frame angle 150 and the shank axis angle 152 stored in the storage step 322. The electronic controller 220 can perform appropriate calculations and equations to determine the appropriate adjustments via extension and retraction of the tilt actuator 144 and/or lift actuator 148 to return the ripper tip 132 to the desired digging depth and digging angle.

In another embodiment, the reposition shank sequence 320 can be a dynamic or active programming routine. The electronic controller 220, to reduce travel resistance, can be further configured to actuate the lift actuator 148 to vertically raise the ripper 102 with respect to the terrain surface 104 and to vertically lower the ripper 102 with respect to the terrain surface 104 to reposition the ripper 102. For example, in another measurement step 326, the control system 200 can measure the current travel resistance presented by the terrain conditions opposing travel of the mobile machine 100 in the travel direction 118. In a proportional repositioning step 328, the control system 200 can adjust the lift actuator 148 connected to the rigid mounting link 140 and thus to the mounting member 136 in proportional relation to the measured travel resistance.

For example, if the travel resistance is excessive or increasing, the electronic controller 220 can retract the lift actuator 148, increasing the mounting frame angle 150 and lifting the mounting member 136 from the terrain surface 104. Less of the ripper shank 130 is therefore positioned in the terrain substrate 106 and the ripper 102 therefore encounters less travel resistance. If the measured travel resistance is decreasing, the electronic controller 220 can adjust the lift actuator 148 to decrease the mounting frame angle 150 and vertically lower the ripper shank 130 deeper into the terrain substrate 106 for more effective ripping.

In another embodiment, the electronic controller 220 can be configured to execute the penetration sequence independently of sensory input. For example, the electronic controller 220 can actuate the tilt actuator 144 to tilt the shank axis 134 rearward, away from the machine chassis 110, and to direct the ripper tip 132 toward the terrain surface 104. The electronic controller 220 can next actuate the lift actuator 148 to vertically move the ripper shank 130 the toward terrain surface 104 and to penetrate the terrain surface with the ripper tip 134.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mobile machine comprising:

a machine chassis supported on a plurality of traction devices for traveling over a terrain surface in a travel direction;

a ripper attached to the machine chassis and including a ripper shank defining a shank axis and a ripper tip at a distal end of the ripper shank for penetrating the terrain surface;

one or more sensors configured to determine a travel resistance to travel of the mobile machine over the terrain surface;

a tilt actuator connected between the machine chassis and the ripper, the tilt actuator configured to tilt the shank axis with respect to the terrain surface;

a lift actuator operatively connected between the machine chassis and the ripper, the lift actuator operatively configured to vertically move the ripper with respect to the terrain surface; and an electronic controller in communication with the one or more sensors and associated with the tilt actuator and the lift actuator, the electronic controller configured to;

determine that the travel resistance is excessive;

execute, based on determining the travel resistance is excessive, a shank adjustment sequence by actuating one or more of the tilt actuator or the lift actuator to move the ripper with respect to the machine chassis and reduce the travel resistance; and based on a reduction in the travel resistance, execute a reposition shank sequence to move the ripper to a prestored position.

2. The mobile machine of claim 1, wherein the shank adjustment sequence includes actuating the tilt actuator to tilt the shank axis rearward, away from the machine chassis, and forward toward the machine chassis with respect to the travel direction.

3. The mobile machine of claim 2, wherein the shank adjustment sequence includes actuating the lift actuator to vertically raise the ripper with respect to the terrain surface.

4. The mobile machine of claim 3, wherein the electronic controller is further configured to execute the reposition shank sequence by actuating the lift actuator to vertically lower the ripper with respect to the terrain surface.

5. The mobile machine of claim 4, wherein the electronic controller is further configured to store an actuation setting of the lift actuator and an actuation setting of the tilt actuator for the reposition shank sequence.

6. The mobile machine of claim 1, wherein the electronic controller is further configured to determine that the travel resistance is excessive based on the travel resistance exceeding a travel resistance threshold.

7. The mobile machine of claim 1, wherein, to determine the travel resistance, the one or more sensors include an engine sensor configured to measure load on a power source of the mobile machine.

8. The mobile machine of claim 1, wherein the one or more sensors include a ground speed sensor and a drivetrain sensor, and the electronic controller, to determine the travel resistance, is further configured to determine machine slippage based on the ground speed sensor and the drivetrain sensor.

9. The mobile machine of claim 1, wherein the electronic controller is further configured to execute a penetration sequence by:

actuating the tilt actuator to tilt the shank axis rearward, away from the machine chassis, and to direct the ripper tip toward the terrain surface; and actuating the lift actuator to vertically move the ripper toward terrain surface and to penetrate the terrain surface with the ripper tip.

10. The mobile machine of claim 1, wherein the electronic controller is further configured to actuate the lift actuator to vertically adjust the ripper with respect to the terrain surface in proportion to the travel resistance.

11. The mobile machine of claim 10, wherein the electronic controller is further configured to vertically raise the ripper with respect to the terrain surface when the travel resistance increases and to vertically lower the ripper with respect to the terrain surface when the travel resistance decreases.

12. A method of operating a ripper of a mobile machine, the method including:

digging a terrain substrate with a ripper tip, attached to a ripper shank of the ripper, that is disposed in the terrain substrate by travel of the mobile machine in a travel direction over a terrain surface;

determining a travel resistance to travel of the mobile machine over the terrain surface;

determining that the travel resistance is excessive;

executing a shank adjustment sequence by actuating one or more of a tilt actuator or a lift actuator to move the ripper with respect to terrain substrate to reduce the travel resistance, and based on a reduction in the travel resistance, execute a reposition shank sequence to move the ripper to a prestored position.

13. The method of claim 12, wherein the shank adjustment sequence includes a tilt adjustment actuating the tilt actuator to tilt the ripper shank rearward of the mobile machine and forward toward the mobile machine with respect to the travel direction.

14. The method of claim 13, wherein the shank adjustment sequence further includes a lift adjustment adjusting the lift actuator to vertically raise the ripper with respect to the terrain surface.

15. The method of claim 14, further comprising executing the reposition shank sequence actuating the lift actuator to vertically lower the ripper with respect to the terrain surface.

16. The method of claim 12, further comprising actuating the lift actuator to vertically adjust the ripper with respect to the terrain surface in proportion to the travel resistance.

17. The method of claim 12, wherein determining the travel resistance is based on one or more of measuring load on a power source of the mobile machine or measuring machine slippage with respect to the terrain surface.

18. A control system for controlling a ripper of a mobile machine, the control system comprising:

an actuator control operatively associated with a tilt actuator and a lift actuator that are configured to tilt a shank axis of the ripper with respect to a terrain surface and vertically move the ripper with respect to the terrain surface, respectively;

one or more sensors configured to measure a travel resistance to travel of the mobile machine in a travel direction over the terrain surface; and an electronic controller configured to determine that the travel resistance is excessive and execute a shank adjustment sequence by actuating one or more of the tilt actuator or the lift actuator to move a ripper shank and a ripper tip with respect to a terrain substrate to reduce the travel resistance, and based on a reduction in the travel resistance, execute a reposition shank sequence to move the ripper to a prestored position.

19. The control system of claim 18, wherein the shank adjustment sequence includes actuating the tilt actuator to tilt the ripper shank rearward of the mobile machine and forward toward the mobile machine with respect to the travel direction.

20. The control system of claim 19, wherein the shank adjustment sequence includes actuating the lift actuator to vertically raise the ripper shank and the ripper tip with respect to the terrain surface.

* * * * *